US006561377B1

(12) United States Patent
Pearson et al.

(10) Patent No.: US 6,561,377 B1
(45) Date of Patent: May 13, 2003

(54) VACUUM DRUM PILL COUNTER

(75) Inventors: Walter G. Pearson, Pineville, LA (US); Dennis J. Murdock, Dry Prong, LA (US)

(73) Assignee: Pearson Research & Development, LLC, Alexandria, LA (US)

( * ) Notice: Subject to any disclaimer, the term of this patent is extended or adjusted under 35 U.S.C. 154(b) by 61 days.

(21) Appl. No.: 10/017,113

(22) Filed: Dec. 14, 2001

(51) Int. Cl.[7] ..... G07F 11/00
(52) U.S. Cl. ..... 221/7; 221/13
(58) Field of Search ..... 221/7, 13, 211, 221/97, 203, 200, 201, 277, 278; 111/177, 178

(56) References Cited

U.S. PATENT DOCUMENTS 4,018,358 A 4/1977 Johnson et al. ..... 221/7
4,697,721 A * 10/1987 Johnson et al. ..... 221/211
6,085,938 A * 7/2000 Coughlin ..... 221/277

* cited by examiner

*Primary Examiner*—Kenneth W. Noland
(74) *Attorney, Agent, or Firm*—Jones, Walker, Waechter, Poitevent, Carrere & Denegre, LLP

(57) ABSTRACT

A vacuum driven pill counter includes a counter housing with a pill discharge aperture formed therein. An integrally formed vacuum drum is rotatably positioned in the housing and the vacuum drum includes a front wall, a rear wall, and a perimeter wall. The front wall of the vacuum drum has a plurality of pill apertures formed therein. A vacuum source communicates with the housing such that the vacuum sources is capable of drawing a vacuum through the pill apertures formed in the vacuum drum and a torque source is operatively connected to the vacuum drum in order to rotate the vacuum drum. A pill shelf is positioned adjacent to the front wall of the vacuum drum and a pill separator removes pills retained on the pill apertures while a pill sensor detects pills which are removed by the pill separator and exit the discharge aperture. Additionally, the pill counter may include a pill feeder. The pill feeder has a frame with a top and bottom aperture and with the bottom aperture being positioned over an opening in the counter housing. A pill reservoir is positioned on the frame to allow pills to flow into the top aperture of the frame. A feed gate positioned within the frame is slidably movable between the top and bottom apertures.

27 Claims, 14 Drawing Sheets

Electric System
Counter

VACUUM DRUM PILL COUNTER

BACKGROUND OF INVENTION

The present invention relates to pill or tablet counting machines. In particular, the present invention relates to counting machines which handle and dispense the pills or tablets by use of a vacuum source.

The prior art includes attempts to utilize a vacuum source to move pills within a pill counting machine; for example U.S. Pat. No. 4,018,358 to Johnston, et al (the "'358 patent"). The '358 patent includes a flat disk with apertures formed along the perimeter of the disk. The disk is placed against a dish-like vacuum drive wheel and a vacuum applied to the drive wheel such that suction is created at each of the apertures in the disk. The disk is positioned such that a collection of loose pills will rest against the disk. The suction force moves pills toward and hold pills against the apertures in the disk. As the disk rotates, the pills are carried with the apertures. At some point along the rotational path of the apertures in the disk, the pills are dislodged from the aperture by a surface adjacent to the disk.

However, there are several disadvantages associated with the device disclosed in the '358 Patent. For example, the disk is a separate piece from the drive wheel and therefore, must form at least a minimal seal along the entire perimeter of the drive wheel. Additionally, the '358 Patent teaches the use of a continuously feeding pill cassette to position pills against its flat disk. This can result in an excessive number of pills collecting against the disk which can in turn adversely affect the consistent retention of pills on the disk's pill apertures. To help alleviate this problem, the '358 Patent discloses a series of spokes radially extending from the hub on which the disk rotates. The purpose of these spokes is to agitate the pills and prevent them from bridging together. However, these spokes have the undesirable tendency to chip, break, or otherwise damage the pills. Additionally, when striking pills, especially soft or uncoated pills, these spokes tend to create large amounts of dust which create a cross-contamination hazard, degrade the operation of sensors, and clog air filters associated with the vacuum source.

An effective vacuum driven pill counter which overcomes these disadvantages would be a significant improvement in the art.

SUMMARY OF INVENTION

The present invention provides a vacuum driven pill counter. The counter includes a counter housing with a pill discharge aperture formed therein. An integrally formed vacuum drum is rotatably positioned within the housing and the vacuum drum includes a front wall, a rear wall, and a perimeter wall. The front wall of the vacuum drum has a plurality of pill apertures formed therein. A vacuum source communicates with the housing such that the vacuum source is capable of drawing a vacuum through the pill apertures formed in the vacuum drum and a torque source is operatively connected to the vacuum drum in order to rotate the vacuum drum. A pill shelf is positioned adjacent to the front wall of the vacuum drum and a pill separator removes pills retained on the pill apertures while a pill sensor detects pills which are removed by the pill separator and exit the discharge aperture.

A second embodiment does not have an integrally formed vacuum drum, but does include a pill feeder. The pill feeder has a frame with a top and bottom aperture, with the bottom aperture being positioned over an opening in the counter housing. A pill reservoir is positioned on the frame to allow pills to flow into the top aperture of the frame. A feed gate positioned within the frame is slidably movable between the top and bottom apertures.

DETAILED DESCRIPTION OF INVENTION

Figure 1:
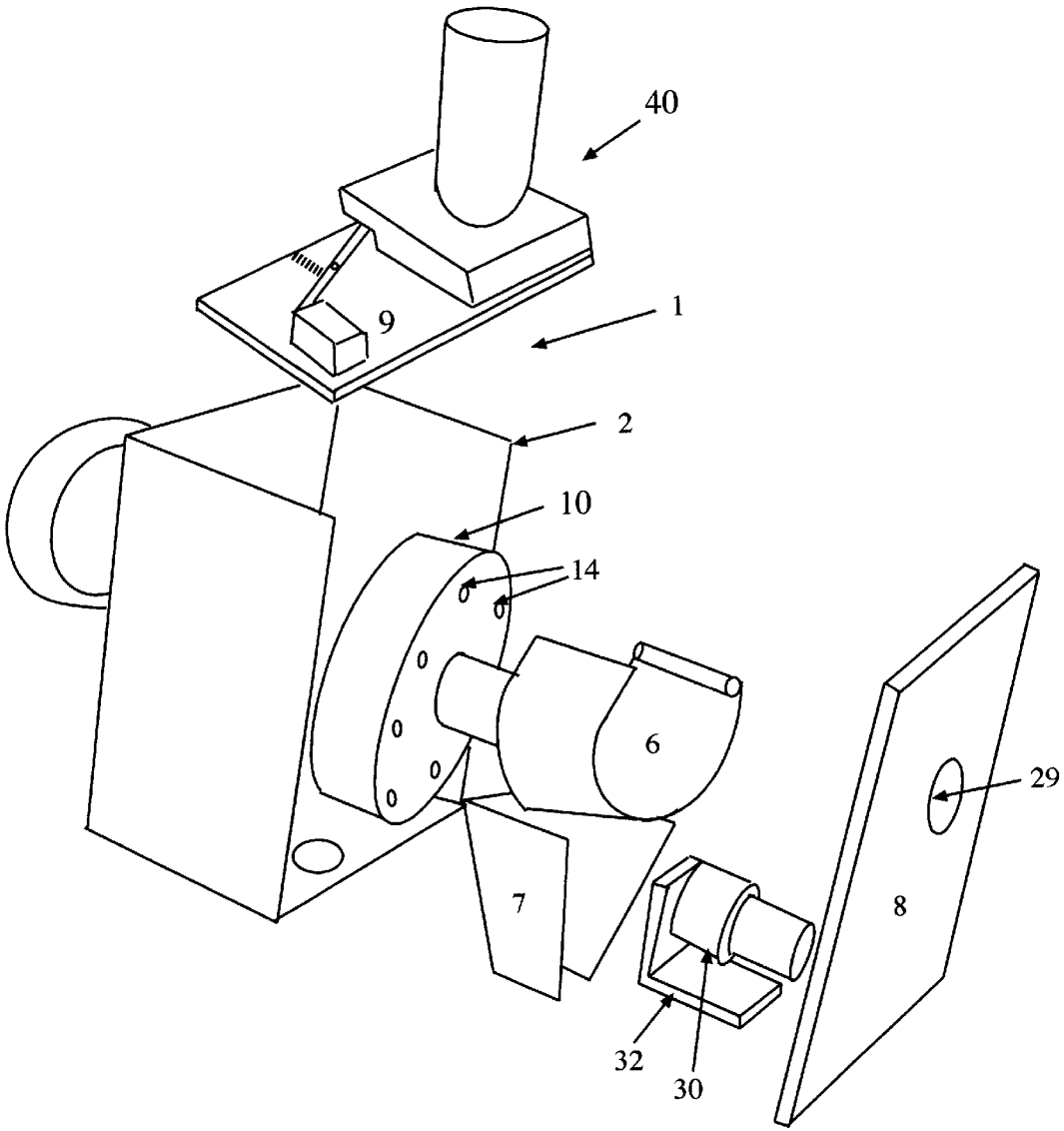
FIG. 1 is an exploded view of the pill counter of the present invention.

The vacuum driven pill counter of the present invention is shown in FIGS. 1–14. In the drawings, many details pertaining to fabrication of the invention are well-established in the machine construction arts and are not material to the points of novelty, are omitted in the interest of descriptive clarity and efficiency. Additionally, the term "pill" as used herein can mean any form of pill, tablet, or capsule related to medication, vitamins, or dietary supplements. Moreover, any approximately pill sized article regardless of whether the article is related to medications, vitamins, or dietary supplements is intended to come within the definition of the term "pill" as used in the present invention.

Figure 2:
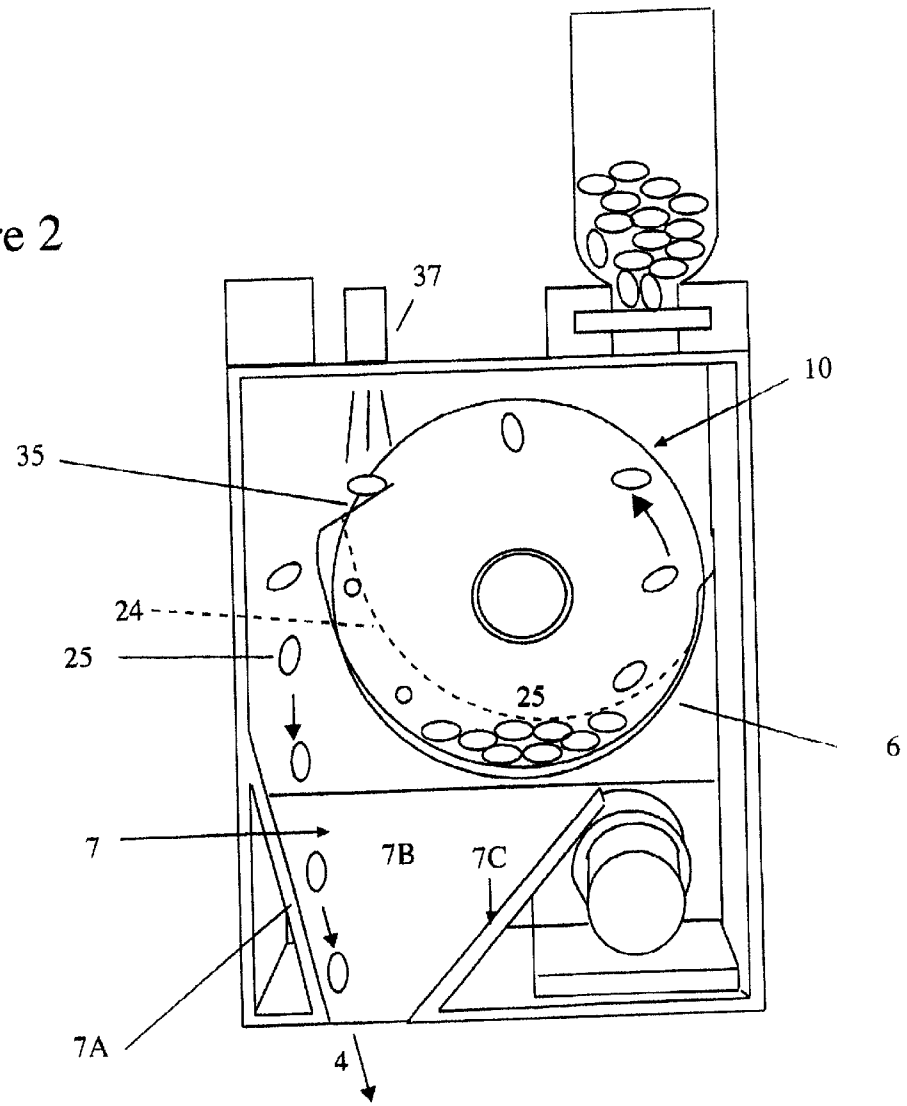
FIG. 2 is front view of the pill counter with the housing's front wall removed.
Figure 3:
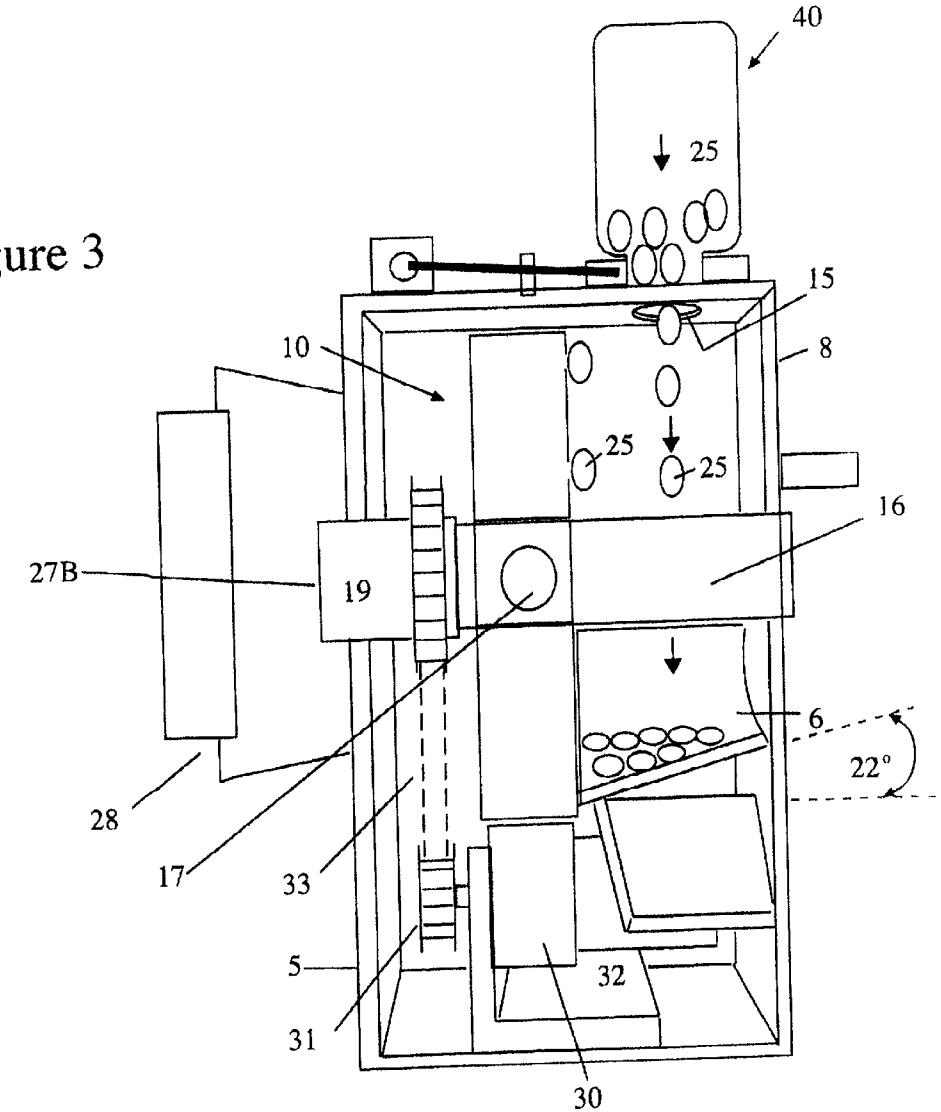
FIG. 3 is a side sectional view of the pill counter.

FIG. 1 is an exploded view of pill counter 1 which illustrates many of the main components from which pill counter 1 is constructed. FIG. 1 shows a generally rectangular housing 2 with front wall 8 and top wall 9 separated from housing 2. Positioned within housing 2 will be vacuum drum 10, pill shelf 6, pill chute 7 leading to discharge aperture 4, and motor 30 positioned on motor mount 32. Additionally, a pill feeder 40 will be positioned upon top wall 9. FIG. 3 shows another main component of pill counter 1 which is vacuum source 28 (which may alternatively be referred to herein as "blower" 28). More detailed views of these components and their interaction are seen in FIGS. 2–11.

Figure 4:
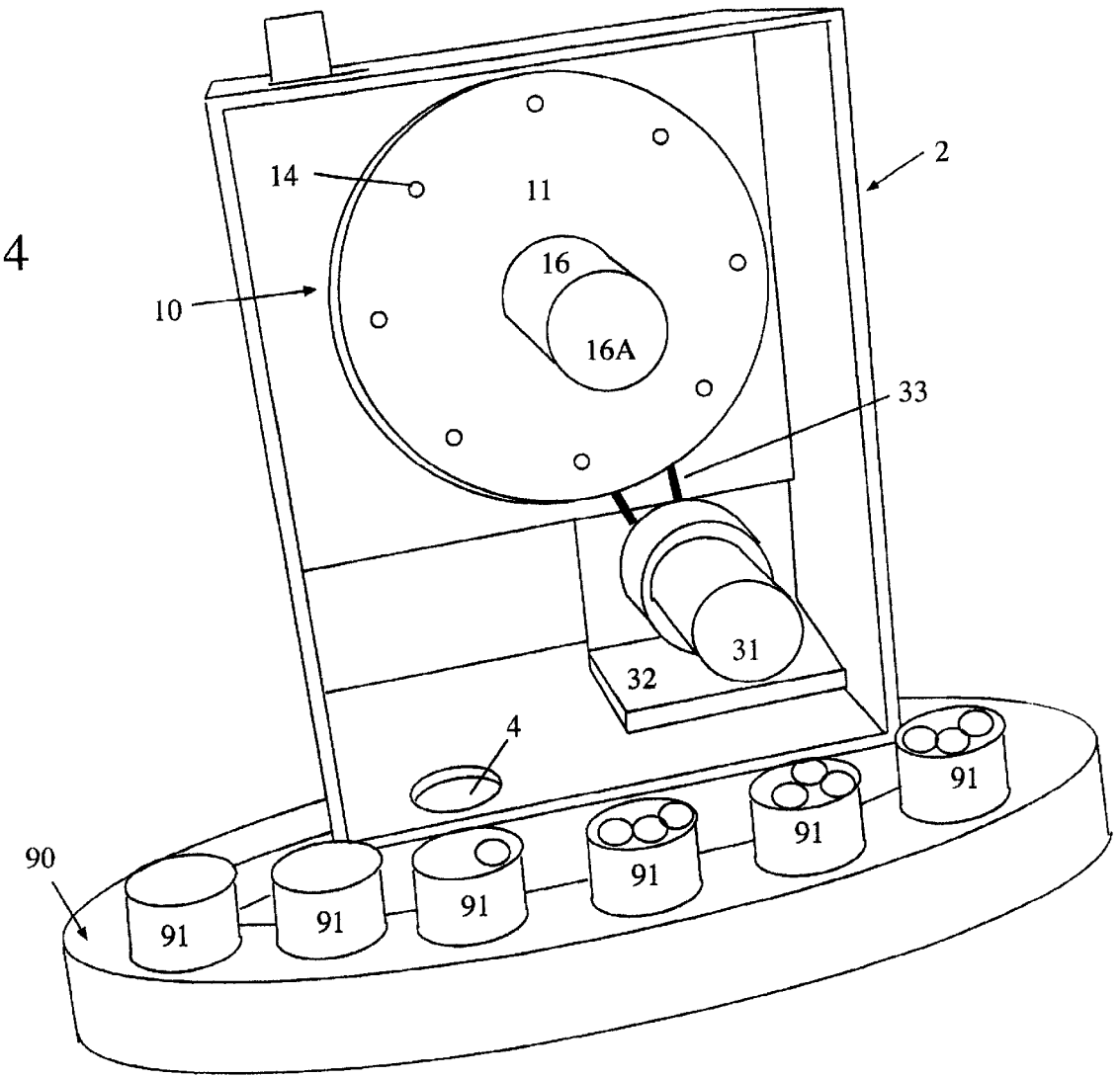
FIG. 4 is a front view of the vacuum drum utilized by the pill counter positioned within the counter housing.

FIG. 4 shows a front prospective view of vacuum drum 10 including front drum wall 11, pill apertures 14, and hollow drum shaft 16. It will be understood that drum shaft 16 has an end cap 16*a* which closes off shaft 16 and prevents air from entering that end of drum shaft 16. Other elements of vacuum drum 10 are better seen in the rear prospective view of FIG. 7. This Figure illustrates how vacuum drum 10 includes rear wall 12 and perimeter wall 13. Generally, front wall 11, rear wall 12, perimeter wall 13 and drum shaft 16 will be integrally formed. In other words, the connecting edges of front wall 11, rear wall 12, perimeter wall 13 and drum shaft 16 will be fixedly attached such that a substantially permanent vacuum seal is formed at all connecting edges of these elements. This type of integral drum construction should be distinguished from the prior art such as the '358 Patent where the disk was removably placed against the dish-like drive wheel and retained in position by gravity and suction forces. Vacuum drum 10 will preferably be constructed of an inexpensive material such as cardboard or plastics, so it can be used only once or for a limited number uses and then be discarded to avoid cross-contamination. The material should be one approved by the Food and Drug Administration for contact with pharmaceuticals. For example, one preferred material is provided under the tradename Pet-G-Vivak by Sheffield Plastics, Inc., Salisbury Road, Sheffield, Mass., 01257. Positioned along drum shaft 16 between front wall 11 and rear wall 12 is a vacuum port 17. Vacuum port 17 will allow air to be drawn through pill apertures 14, through the body of vacuum drum 10, and finally through drum shaft 16 into blower 28. Rear wall 12 will also include a switch activator 18 (explained below) and an extended section 26 of drum shaft 16. Extended section 26 forms shaft aperture 27*a* and includes locking notches 22 which engage locking pins 21 on drum hub 19. Drum hub 19 is also a hollow shaft with a rear aperture 27*b*, locking pins 21 and timing gear 20. Drum hub 19's outer diameter is sized to tightly fit within the inner diameter of extended section 26 and form a vacuum seal between those elements. Drum hub 19 will include a timing gear 20 formed thereon.

FIG. 3 best illustrates how vacuum drum 10 is positioned within housing 2 of pill counter 1. Vacuum drum 10 is supported in housing 2 by drum shaft 16 engaging aperture 29 in front wall 8 (see FIG. 1) and by drum hub 19 engaging a similar aperture formed in rear housing wall 5. To ensure low friction rotation of vacuum drum 10, it may be desirable to use conventional rotary bearings where drum hub 19 and drum shaft 16 engage rear wall 5 and front wall 8 respectively. Alternatively, the apertures and rotating surfaces could be constructed of or lined with a low friction material. A timing belt 33 will extend between timing gear 20 and the timing gear 31 on motor 30. Timing belt 33 transfers torque from motor 30 to vacuum drum 10 and is used to control the rotation of vacuum drum 10 by controlling motor 30. In one preferred embodiment, timing gears 20 and 31 are sized to reduce the rotational speed of vacuum drum 10 to approximately one half the output speed of motor 30. Blower 28 will be positioned over drum hub 19's rear aperture 27*b* and will apply a vacuum at aperture 27*a*. While not shown in the drawings, it will be understood that blower 28 may be equipped with a filter to prevent pill dust from being exhausted into the environment surrounding the pill counter. Motor 30 may be any conventional electric motor and preferable a highly controllable, brushless motor, the reasons for which will become clear below. One suitable motor is sold by Pittman Motor located at 343 Godshall Drive, Harleysville, Pa. 19438 and is sold under model designation 9413-3 and has a 65.5:1 speed reduction ratio based on the motor's internal gearing. Blower 28 may be any conventional blower, but preferably a comparatively small, quiet regenerative blower capable of moving approximately 40 CFM of air at a pressure equivalent to 24 inches of water. One suitable blower is sold by Ameteck Rotran Technical Products located in Kent, Ohio and is sold under the designation "Mini-Jammer."

Figure 5:
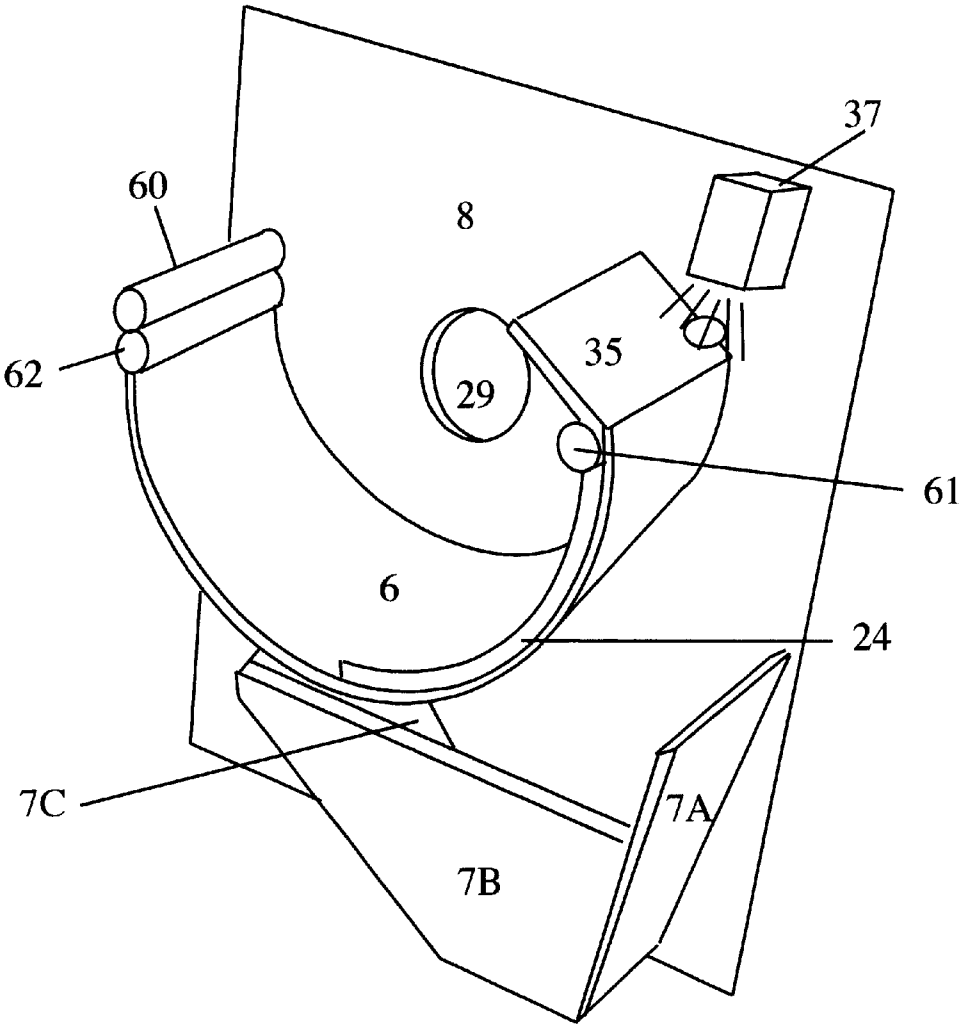
FIG. 5 is a rear view of the pill counter housing's front wall with the pill shelf and pill chute attached thereto.
Figure 6:
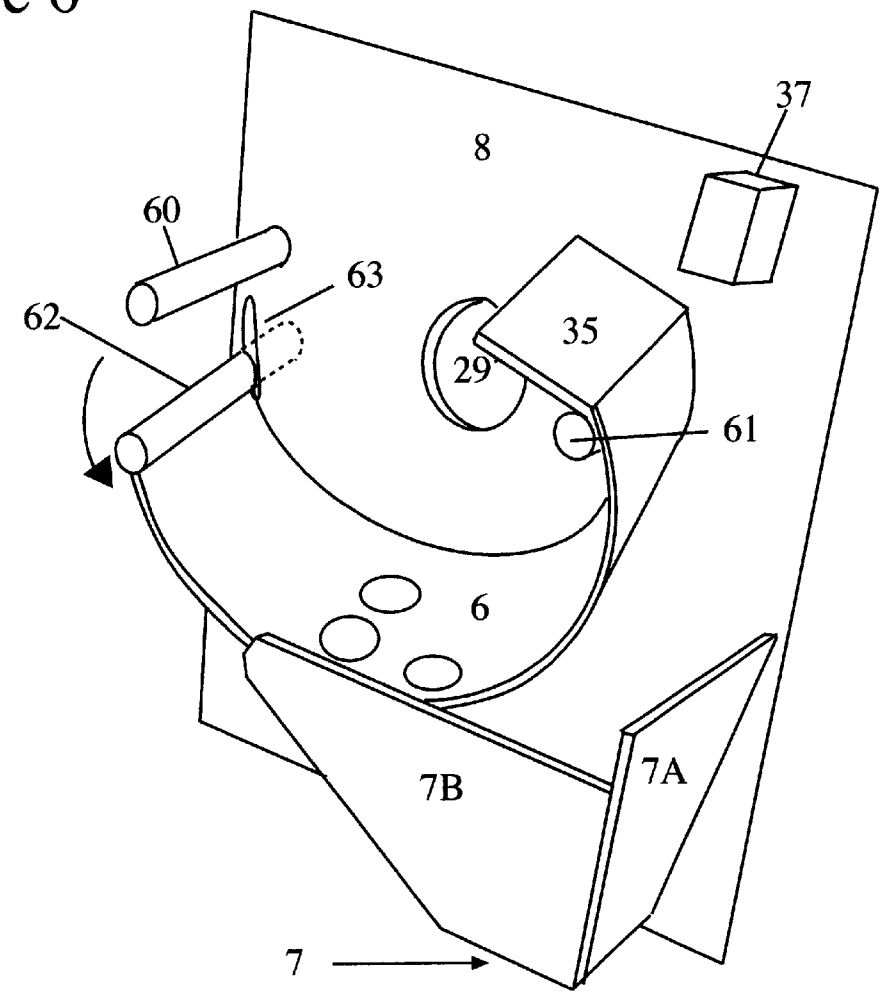
FIG. 6 shows the pill shelf of FIG. 5 in a alternate position.
Figure 7:
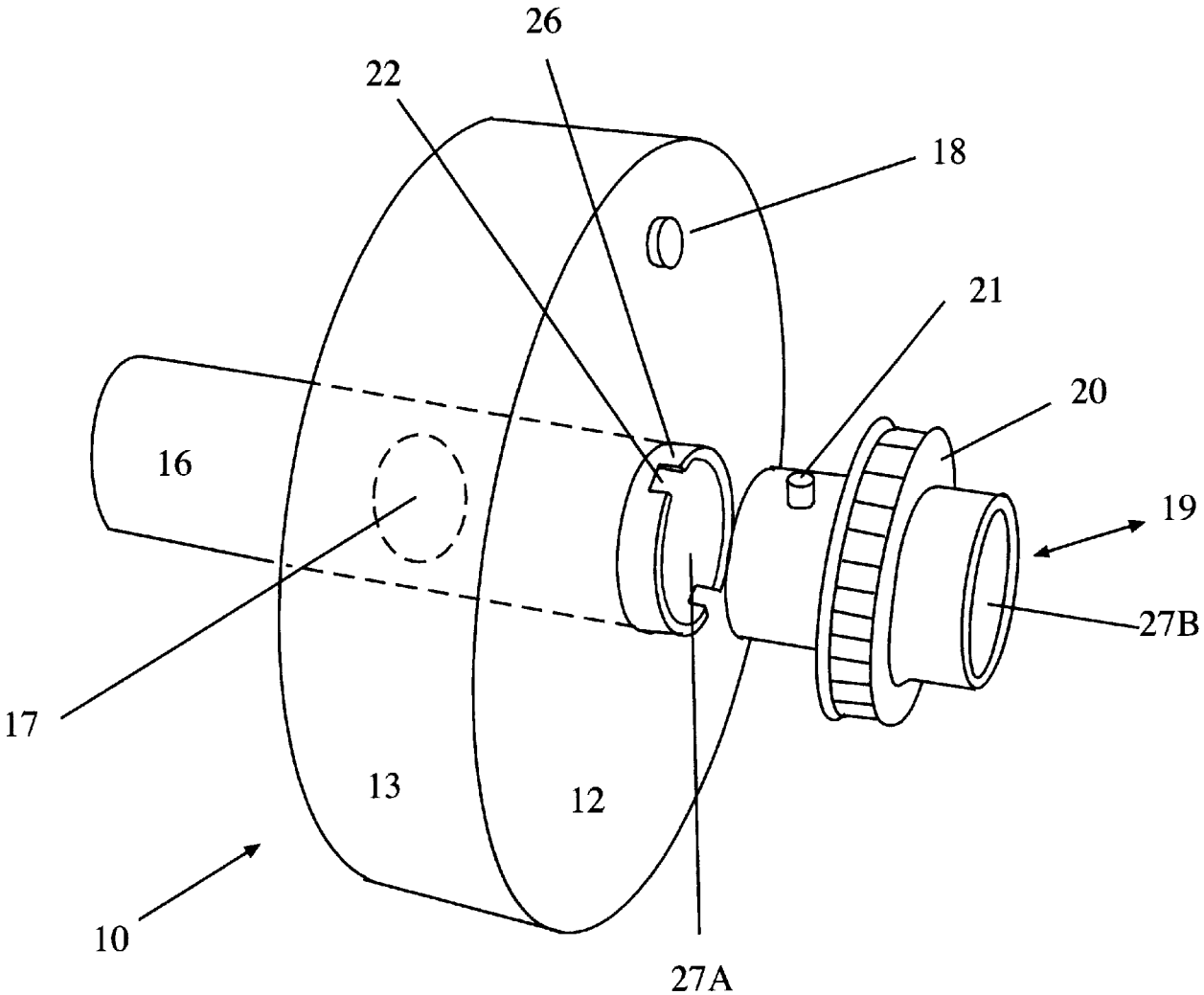
FIG. 7 is a rear perspective view of the vacuum drum.

In addition to vacuum drum 10, counter housing 2 also includes pill shelf 6 and pull chute 7. FIGS. 5 and 6 are views of the inside surface of housing front wall 8 and best illustrate how pill shelf 6 is attached thereto. Pill shelf 6 is generally arcuate in shape and is connected to front wall 8 by way of hinge post 61 and sliding post 62. In a preferred embodiment, the lower section of pill shelf 6 has a sloped surface running downward from wall 8 toward vacuum drum 10 at approximately 22° (best seen in FIG. 3). FIG. 5 further shows a pill aperture blocking strip 24 which will be explained in greater detail below.

FIG. 5 also illustrates how pill separator 35 is positioned on wall 8. In the embodiment shown, pill separator 35 is formed as a folded back extension of pill shelf 6. Pill chute 7 is formed by front wall 8 and chute sections 7*a*, 7*b*, and 7*c*. FIG. 2 (with front wall 8 removed) best shows how chute sections 7*a* and 7*b* are sloped inward to direct pills 25 toward pill discharge aperture 4 in the bottom of housing 2. FIG. 6 demonstrates how sliding post 62 may move downward in slot 63 allowing pill shelf 6 to rotate on hinge post 61. The downward movement of pill shelf 6 will take its bottom edge below the vacuum drum 10. This will allow pills remaining on shelf 6 at the termination of counter 1's use to be manually dumped into pill chute 7. While not shown in the Figures, there will be a device either at sliding post 62 or hinge post 61 which biases sliding post 62 against stop post 60. Additionally, pill chute 7 may be lined with a removable paper filter (not shown).

FIG. 5 shows how a sensor 37 will be positioned above pill separator 35. In a preferred embodiment, sensor 37 will be formed from a white light LED and an optical transistor to detect light reflected from pills passing under the LED. One such sensor is sold by Tri-Tronics of Tampa, Fla. under the name "Smart Eye Pro" model no. SPBWLC. When sensor 37 employs a white light LED, the optical transistor will not only detect reflected light in general, but may also distinguish a limited number of gray levels. The gray level information can give the control circuitry a basis for determining the color of the pill passing sensor 37. The color information may aid in verifying the correct type of pill is being counted. It is preferred that the surface of pill separator 35 be black in order to minimize light reflecting from that surface (as opposed to light reflecting from a passing pill) and possibly giving false readings. Alternatively, sensor 37 could be based on a laser LED and optical transistor (emitting and receiving at a wavelength of approximately 670 um) or an infra-red LED and optical transistor. Nor is sensor 37 necessarily limited to light sensors, but could include any type of sensor capable of detecting a pill passing within the sensor's detection range. And while above pill separator 35 is a convenient position for sensor 37, it could be placed anywhere along the pill's path once the pill has been separated from vacuum drum 10.

Figure 8:
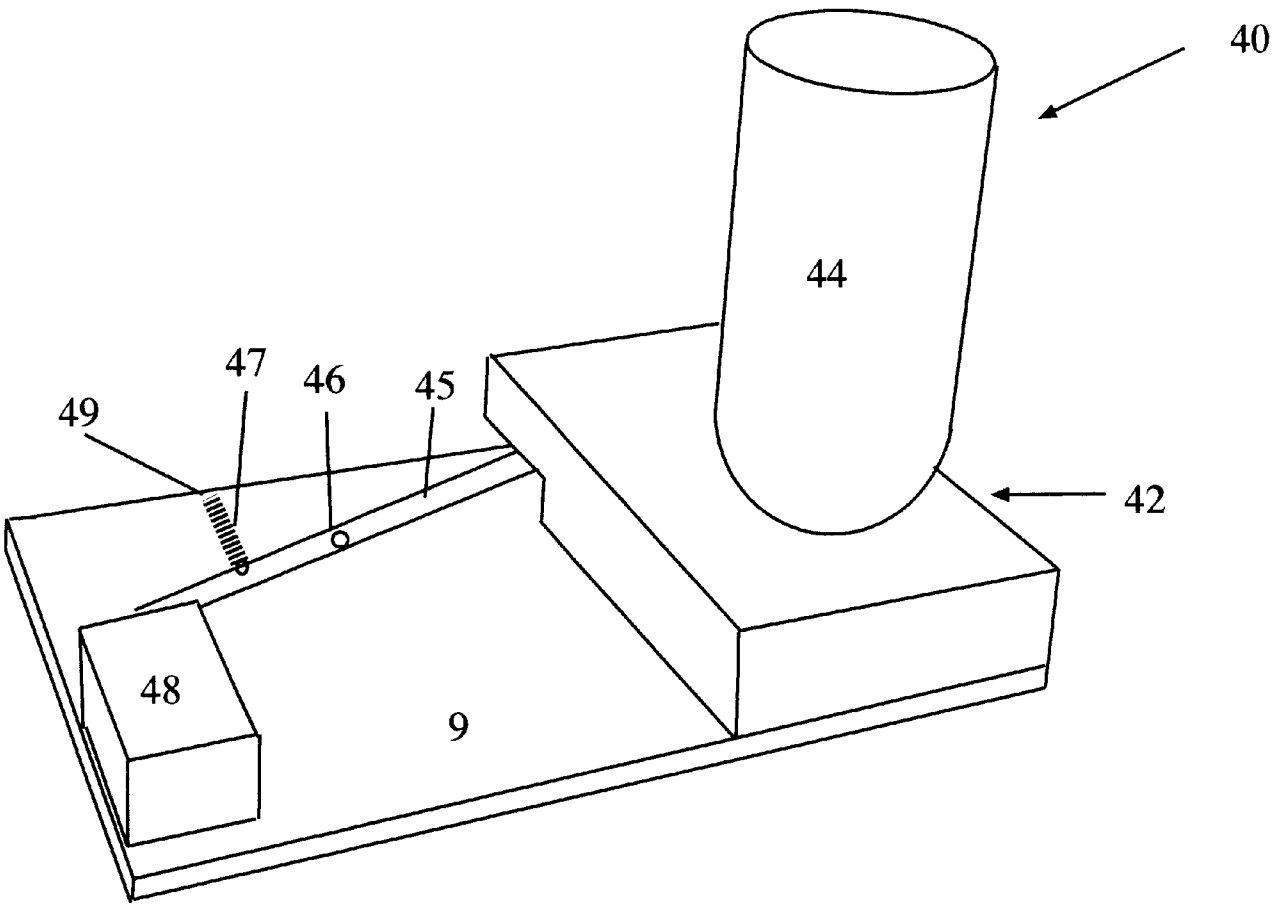
FIG. 8 is perspective view of the pill feeder utilized in the present invention.
Figures 9A, 9B, 10A, 10B:
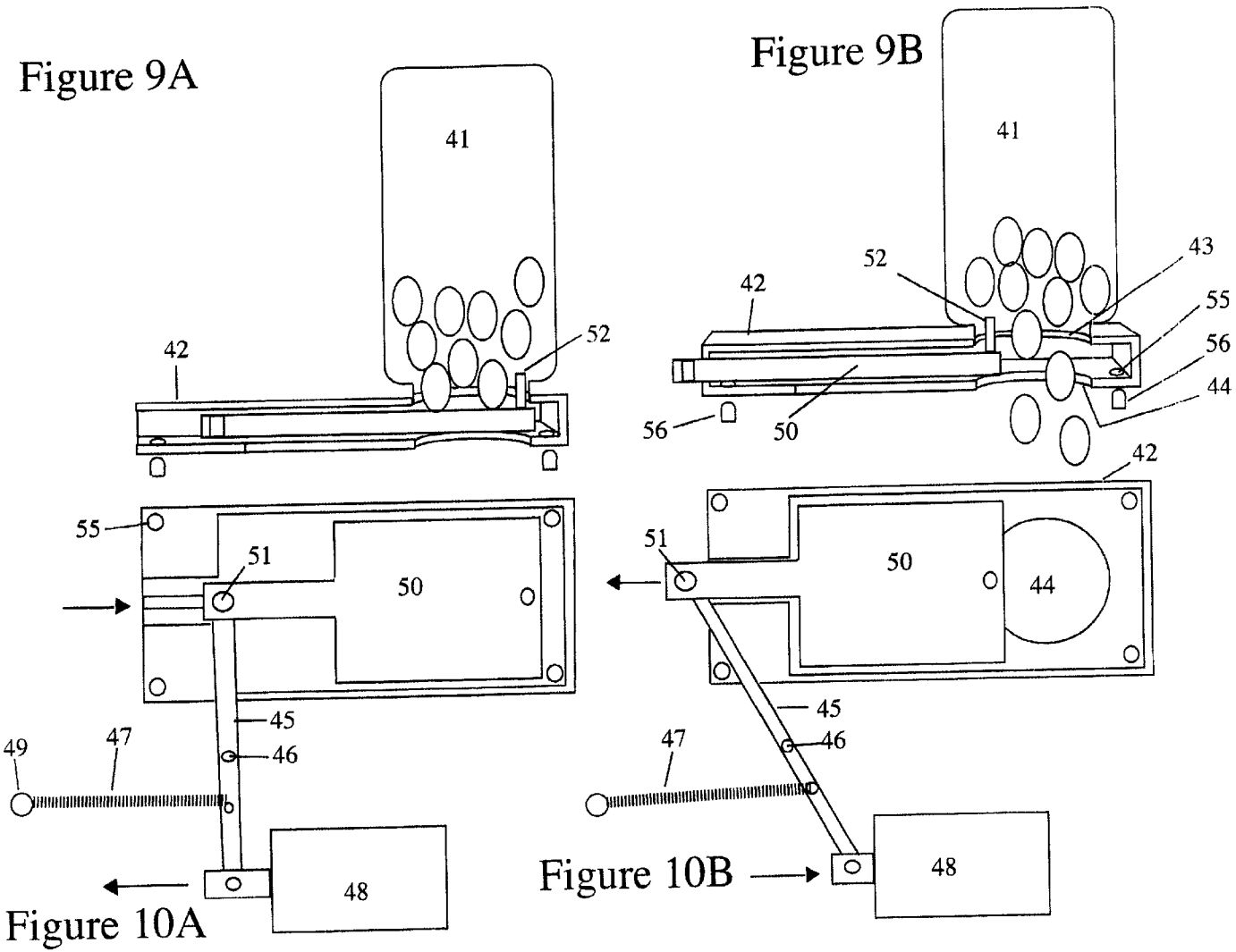
FIGS. 9A and 9B are side views of the pill feeder in the closed and open position respectively.
FIGS. 10A and 10B are top views of FIGS. 9A and 9B, but with the pill reservoir and top of the feeder frame removed.
Figure 11:
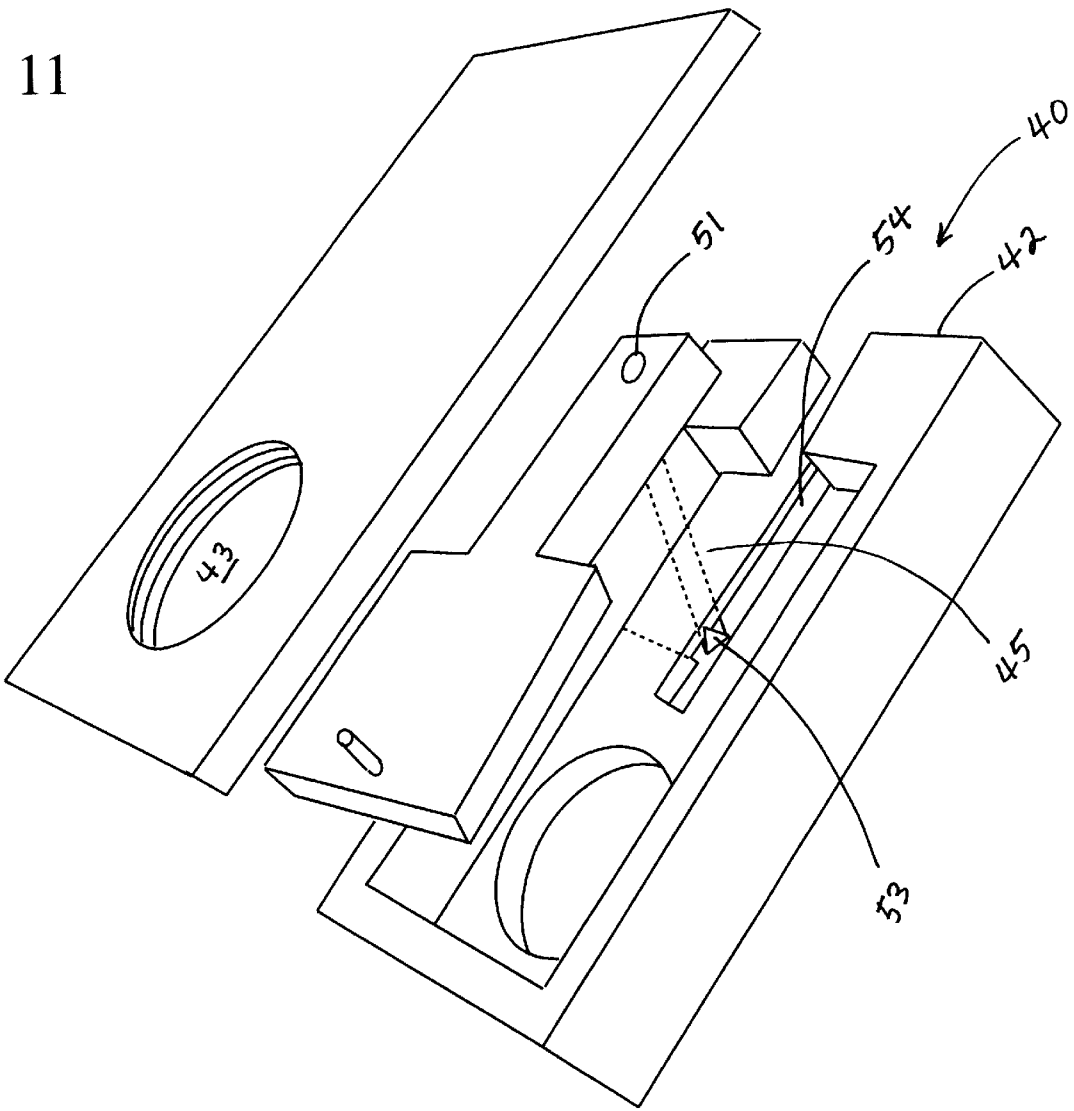
FIG. 11 is exploded view of the pill feeder frame and feed gate.

Another major component of pill counter 1 is pill feeder 40 seen in FIGS. 8–11. FIG. 8 illustrates the main elements of pill feeder 40 positioned upon housing top wall 9. Pill feeder 40 will include pill reservoir 41, feeder frame 42, pivot arm 45, and linear activator device 48. FIGS. 9A and 9B show a side sectional view of feeder frame 42 while FIGS. 10A and 10B show a top view with the upper panel of feeder frame 42 removed. Feeder frame 42 will be position on top wall 9 by way of locking pegs 56 extending from top wall 9 and engaging locking peg apertures 55 formed in the bottom panel of feeder frame 42. In the embodiment shown, reservoir 41 will be a conventional pill stock bottle with a threaded neck section. Alternatively, a universal hopper with a threaded neck section could be used. The top of feeder frame 42 will have an aperture 43 with threaded sidewalls such that the neck of the pill bottle (after the cap has been removed) may be threaded into aperture 43. Slidably positioned within feeder frame 42 will be feed gate 50 which may move between an open position allowing pills in reservoir 41 to pass through a bottom aperture 44 in feeder frame 42 (FIG. 9B) and a closed position blocking the flow of pills (FIG. 9A). Feed gate 50 is moved between its open and closed position by way of pivot arm 45. One end of pivot arm 45 is pinned to rear section 51 of feed gate 50 while the other end of pivot arm 45 is pinned to linear activator device 48. Pivot arm 45 will also be pinned to top wall 9 at pivot point 46 and will be attached to biasing device or spring 47, which is in turn attached at spring anchor 49. It can be seen in FIGS. 10A and 10B how the retraction of linear activator device 48 (which is a solenoid in one preferred embodiment) causes pivot arm 45 to move rear section 51 backwards and open feed gate 50. This motion also places tension on spring 47. When power is not applied to the solenoid, spring 47 rotates pivot arm 45 in the opposite direction and closes feed gate 50. As suggested in FIG. 3, top wall 9 has an aperture 15 over which feeder: frame bottom aperture 44 (FIG. 10B) is position and maintained in place by locking pegs 56. FIG. 9B also shows how the top surface of feed gate 50 will include an agitator finger 52, which agitates the pills above it to prevent bridging or jamming of pills in the neck of pill reservoir 41. It can also be understood from FIG. 9A how pill feeder 40 may be easily removed from top wall 9 and: the pills be retained in pill reservoir 41 by feed gate 50. This allows rapid switching of the type of pills being counted because a separate pill feeder 40 (containing the different type of pills) may be easily positioned on top wall 9 with locking pegs 56. FIG. 11 shows how pivot arm 45 will be positioned under frame 24 and the pin 53 on pivot arm 45 will extend through channel 54 in order to engage the pin aperture in rear section 51. Although not shown, the pill feeder may be any prior art means for singulating pills such as a vibrating platform (e.g. a six inch "Vibratory Feeder Bowl" sold by Vibracraft, Inc. of Manchester, Conn.) or other means of singulating pills (such as disclosed in U.S. Pat. No. 6,286,714, which is incorporated by reference herein), the operation of which is controlled by the micro-controller governing the operation of pill Counter 1.

The operation of pill counter 1 can best be understood with reference to FIGS. 2 and 3. FIG. 2 shows how a group of pills 25 will rest on pill shelf 6. Because pill shelf 6 is inclined downward toward vacuum drum 10 (see FIG. 3), pills 25 will tend to congregate against vacuum drum 10. As vacuum drum 10 in FIG. 2 rotates counter-clockwise, the suction created at pill apertures 14 will cause pills 25 to adhere to pill apertures 24. As a pill 25 reaches pill separator 35, pill 25 will be "scraped off" vacuum drum 10, will move down the incline surface of pill separator 35, fall into pill chute 7 and be directed through pill discharge aperture 4. Normally a pill bottle will be positioned below discharge aperture 4 so that a pill counter 1 may dispense a predetermined number of pills into the bottle. Naturally, as a pill 25 passes over pill separator 35, sensor 37 will detect pill 25 and send an appropriate signal to a micro-controller governing the operation of pill counter 1.

Pill counter 1 will often be used in conjunction with pill bottle or pill container conveyor. FIG. 4 conceptually illustrates a container conveyor 90 positioned below pill counter 1. Container conveyor 90 will advance a pill container 91 to a position immediately below pill discharge aperture 4. Container conveyor 90 maintains pill container 91 at that position for the time required to dispense the correct number of pills into container 91. Container conveyor 90 will then advance the next pill container 91 to the position under discharge aperture 4. As discussed below, container conveyor 91 may be controlled by pill counter 1's micro-controller. One commercially available device which may readily be converted into a suitable container conveyor 90 is manufactured by Kaydon Corporation located in Ann Arbor, Mich. and sold under the designation Custom Turntable Bearings.

In one preferred embodiment, vacuum drum 10 is about six inches in diameter and will have twelve pill apertures 14 with an aperture diameter of about 9/64 of an inch. In operation, this vacuum drum 10 will have a rotational speed of approximately 35 rpm. Additionally, aperture blocking strip 24 will run from beneath pill separator 35 to the approximate center of pill shelf 6 (covering about four pill apertures 14). Since there is no purpose in carrying pills along this section of pill shelf 6, aperture blocking strip 24 acts to block air flowing into the pill apertures 14 covered by blocking strip 24. This effectively increases the suction force at the pill apertures 14 not covered by blocking strip 24 and allows these apertures 14 to more firmly hold pills against the aperture.

Figure 14:
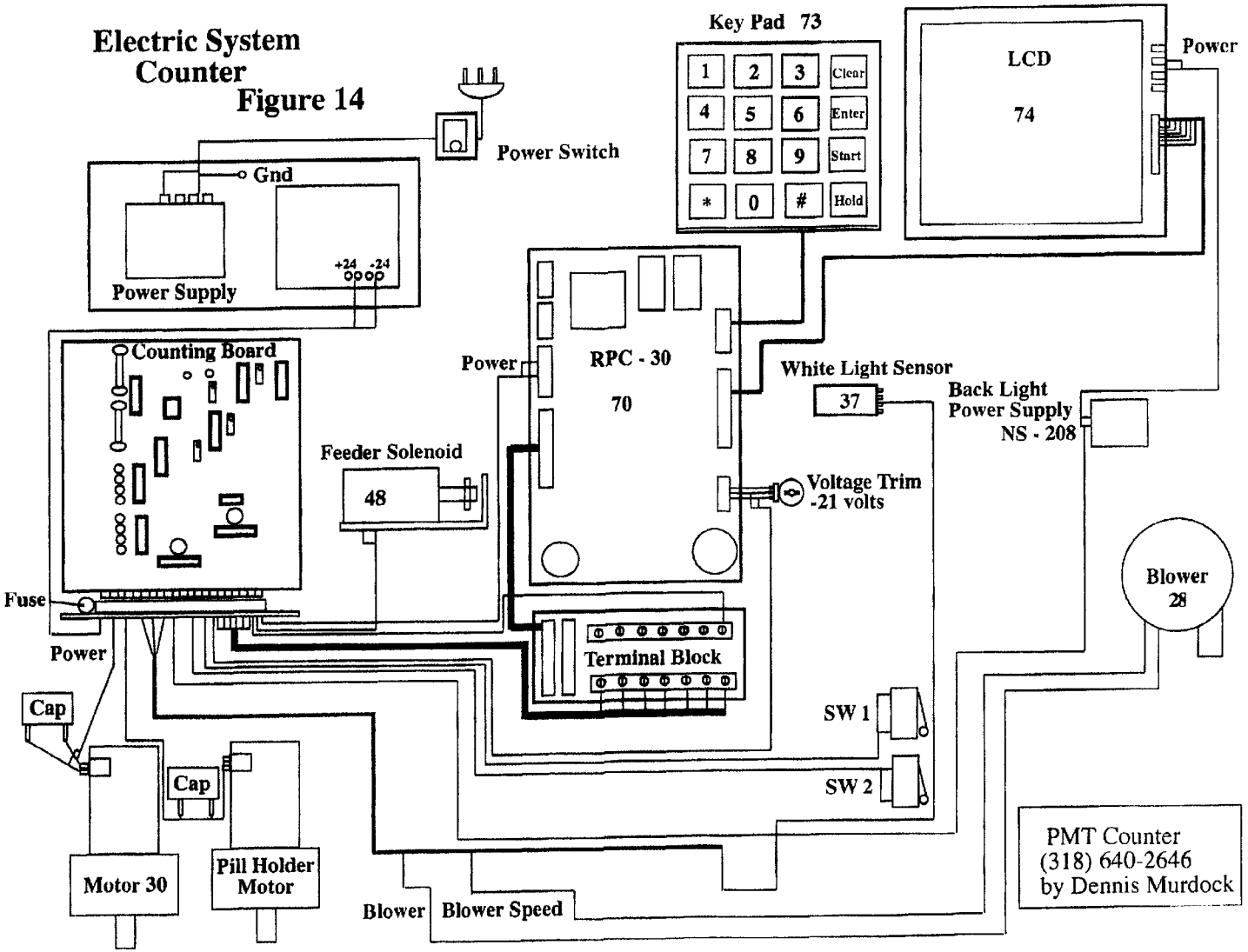
FIG. 14 is a circuitry schematic showing the main electrical components of the pill counter.

FIG. 14 schematically illustrates the interconnection of the electronic components of pill counter 1 and the control circuitry for operating counter 1. In the embodiment shown, the main element of the control circuitry will be micro-controller or micro-processor 70. Numerous conventional micro-processors could serve as micro-controller 70, with one preferred micro-processor being produced by Remote Processing Computing at 7975 E. Harvard Ave., Denver, Colo. and designated as model RPC-30. A conventional key pad 73 and LCD 74 will have inputs communicating with micro-controller 70 and will function as the user interface with pill counter 1. Other components of pill counter 1 will communicate with micro-controller 70 by way of terminal block 83 and counting board 77. Counting board 77 will include conventional circuitry such as optical isolators to translate the relative small voltage signals generated and received by micro-controller 70 into the comparatively high voltage signals which operate the other various electrical components. FIG. 14 shows various elements connected to counting board 77. Power supply 76 will be energize when power switch 82 is activated. Power supply 76 will include a transformer to step down a typical 120 V source to 24 V and supply that 24 V to counting board 77. When signaled by micro-controller 70, counting board 77 will supply power to motor 30, pill container conveyor motor 92, blower 28, white light sensor 37, and pill feeder solenoid 48. Counting board 77 will also supply power to switch 78 and switch 79. Switch 78 is the vacuum drum switch that is triggered each time drum switch activator 18 (shown in FIG. 7) rotates past drum switch 78. For reasons described in greater detail below, switch 78 allows micro-controller 70 to maintain a count of how many rotations vacuum drum 10 makes. Switch 79 is a home switch for pill container conveyor 90. As discussed below, when the last pill container is filled, container conveyor motor 92 is reversed and container conveyor moves backwards until switch 79 is triggered and stops motor 92. Switch 79 ensures that container conveyor will stop at its calibrated home position. Other elements shown in FIG. 14 include back light power supply 80 for LCD 74 and voltage trim 81 for controlling the brightness of LCD 74.

Figure 12:
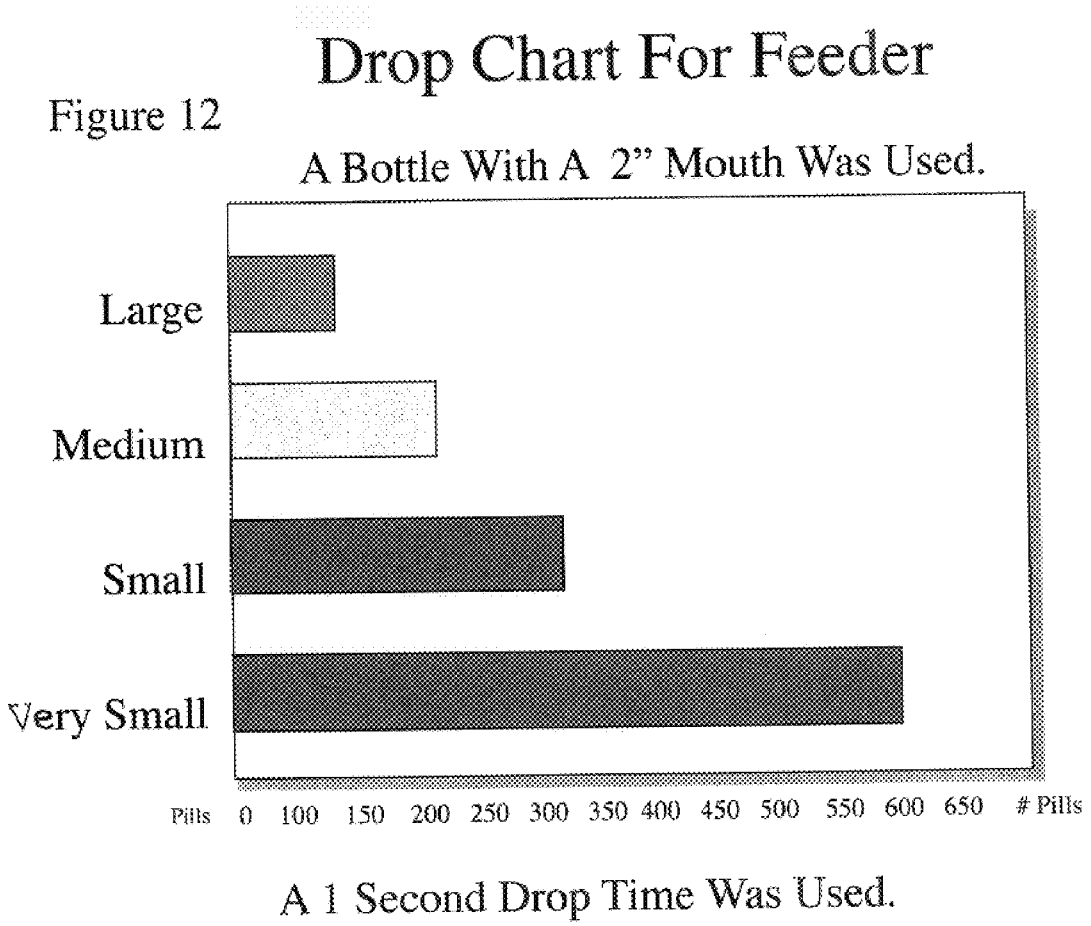
FIG. 12 is chart illustrating the number of pills dropped by the pill feeder as a relation of pill size.

One of the problems found in prior art devices was the lack of a way to effectively limit the number of pills resting next to the vacuum disk. The weight created by a large number of pills may bridge the pills together and prevent the pills being picked up at the pill apertures with the vacuum force available. As described above, one prior art solution was to have an agitator rod strike the collection of pills against the vacuum disk. However this often resulted in broken or chipped pills, and created dust which blocked sensors and clogged filters. The present invention achieves a superior solution to this problem by selectively supplying a limited number of pills to pill self 6 at discrete periods of time. As suggested in FIG. 3, the feed gate 50 of pill feeder 40 will open to allow pills 25 to fall from pill reservoir 41 onto pill shelf 6. As described above, the opening and closing of feed gate 50 is controllable by operation of solenoid 48. In a preferred embodiment, the number of pills 25 dispensed will be approximate to the number of pills 25 which are to be counted into the individual pill bottle to be filled. Typically, this will be between 30 to 60 pills. However, this number may vary depending on the specific use of pill counter 1 and minor experimentation may be easily performed to determine the optimum number of pills to be dispensed to shelf 6 for any given application. The number of pills 25 dispensed by pill feeder 40 will be a function of how long feed gate 50 is in the open position and the size of the pills. FIG. 12 is a chart representing approximately how many pills for a given pill size are dispensed (from a pill reservoir 41 having a two inch mouth) when feed gate 50 is opened for a time period of one second. FIG. 12 classifies pills into four size ranges based upon weight. Large pills are those over 450 grams; medium pills are those from 400–220 grams; small pills are those from 220–100 grams; and extra small pills are those less than 100 grams. As explained below in more detail, the micro-controller 70 may be programmed to open feed gate 50 based on various conditions such as a certain number of pills being counted or pill shelf 6 appearing to be empty of pills.

Figure 13A:
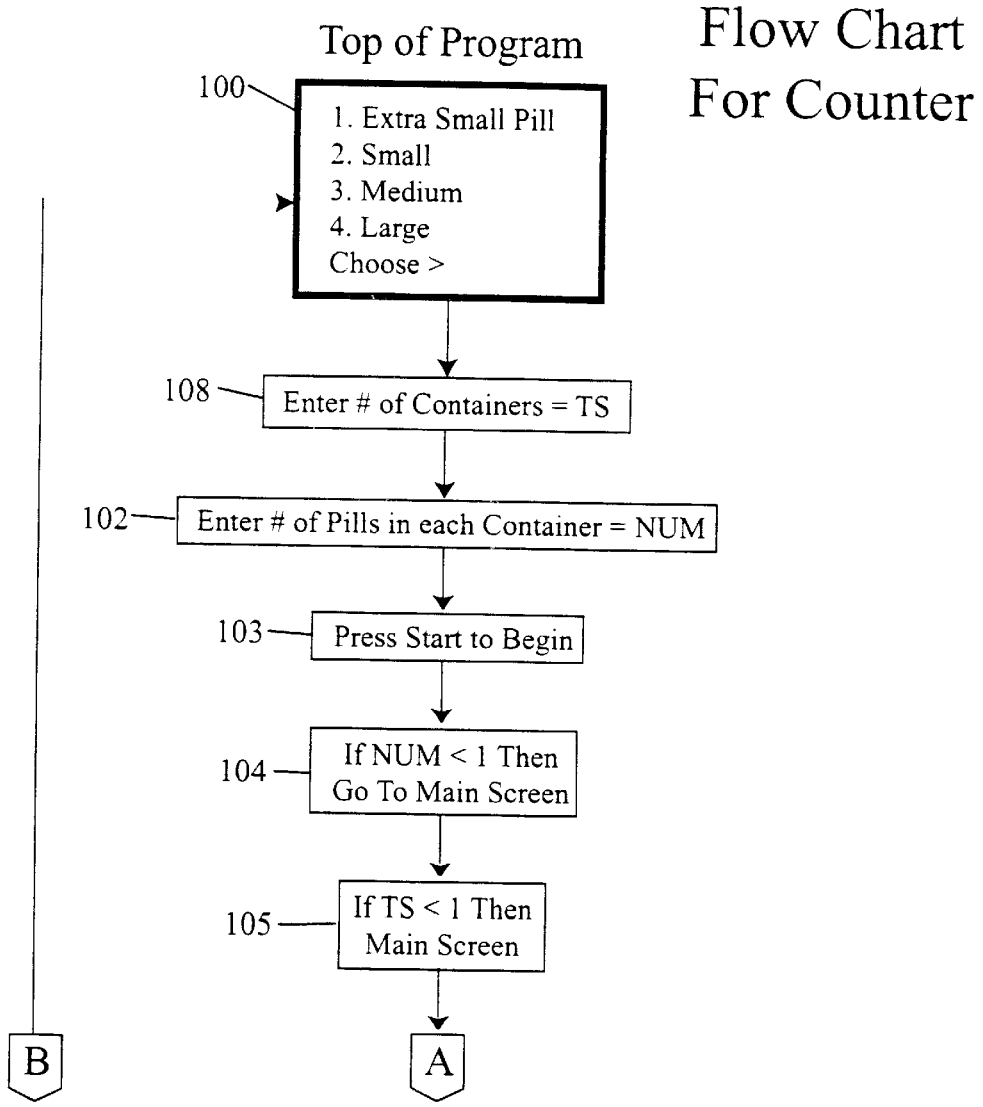
FIGS. 13A and 13B are flow charts illustrating the general decision making process of the counter's control circuitry.
Figure 13B:
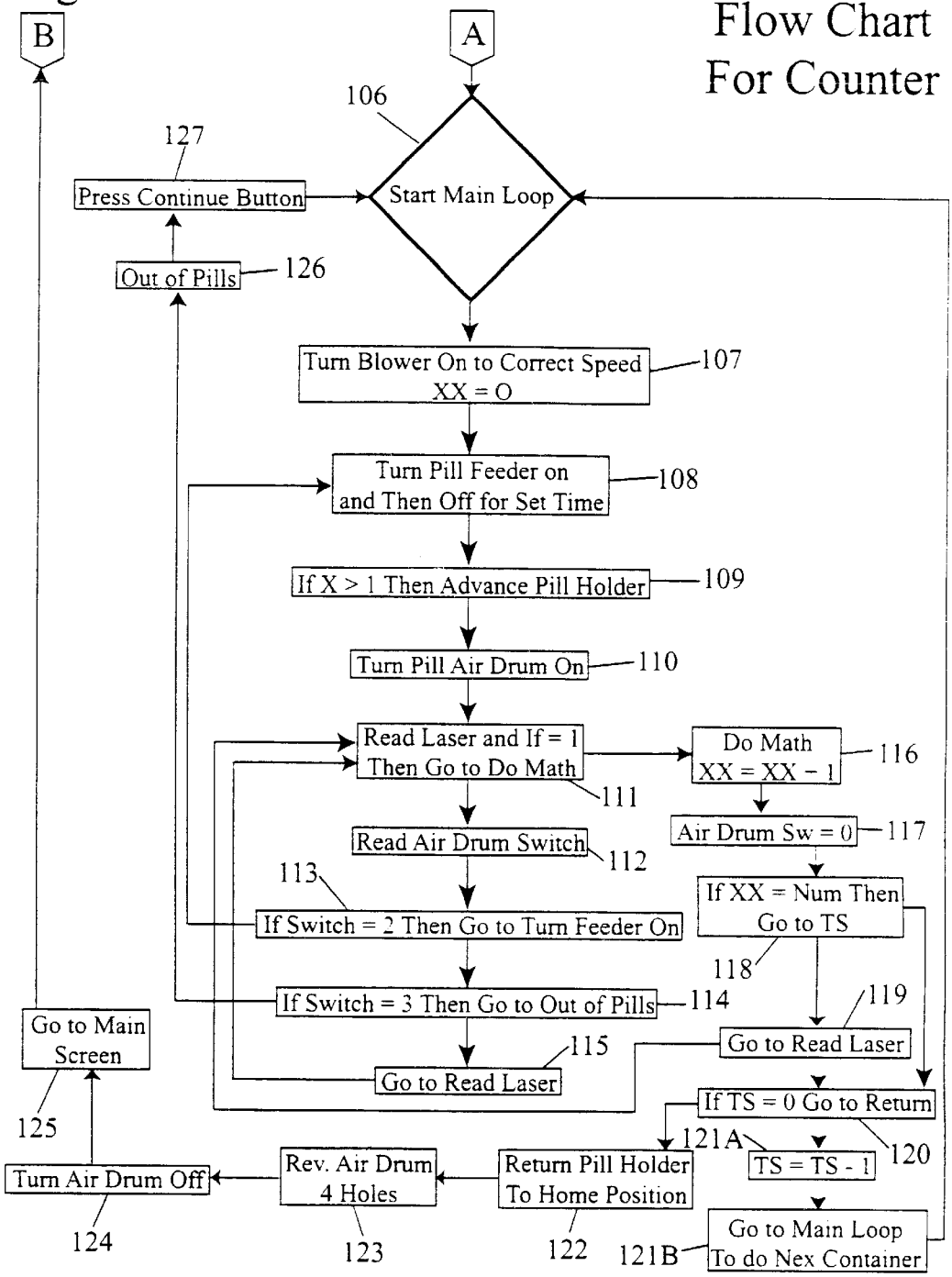

The sequence of steps micro-controller 70 will utilize to operate pill counter 1 are shown in FIG. 13. In step 100, the program will query the user to enter the size of the pills being counted. Step 101 requests the number of pill bottles or containers to be filled (or the number on the pill container conveyor) while step 102 requests the number of pills to be counted into each container. Step 104 checks that the number of pills entered by the user ("NUM") is a positive number and step 105 checks that the number of containers to be filled ("TS") is a positive number. If either of these conditions are not met, the program will return to step 100 and again ask for the number of pills and containers. Step 106 represents the start of the main program loop. In step 107, the blower 28 will be set to a predetermined speed depending on the pill size. Naturally, the larger the pill being counted, the higher the blower speed will be to provide sufficient vacuum force. In terms of blower 28 described above, large pills will utilize the highest available blower speed while the blower speed for the smaller pills nay be proportionally reduced. For example, medium pills may utilize a blower speed of approximately 70% of the highest speed, small pills approximately 60%, and extra small pills approximately 50%. Next, step 108 opens feed gate 50 for a predetermined time based upon the number of pills the user wishes to deposit on pill shelf 6. Step 109 then determines whether the number of pills advanced on the container conveyor ("X") is greater than one and advances to the next pill container if the condition is true. Step 110 activates motor 30 in order to begin the rotation of vacuum drum 10 while the output of senor 37 is read in step 111 to determine if the output is high or one (i.e., a pill has been detected). If a pill is detected, the program branches to "Do Math" step 116, where the number of pills counted by sensor 37 ("XX") is incremented by one and where the Air Drum Switch count is set to zero in step 117. Step 118 determines whether XX is equal to the number of pills which should be counted into each container ("NUM"). If XX is not equal to NUM, the program proceeds to 119 and then back to step 111 in order to await detection of another pill by sensor 37. If XX is equal to NUM in step 118, the program branches to step 120 to determine whether the desired number ("TS") of containers have been filled. If this condition is not true, then TS is decremented by one in step 121*a* and the program is returned to main loop start point 106 by step 121*b*, where a new container will be advanced (step 109) and the counting process begun again for that container. If the condition at step 120 is true, the container conveyor advancing the pill containers will have its motor reversed until it returns to its home position (step 122) while motor will reverse direction to rotate vacuum drum 10 backwards by a distance equal to four pill apertures (step 123) and step 124 then stops the movement of vacuum drum 10 and turns blower 28 off. It will be understood that the purpose of steps 123 and 124 (at the time no more containers are to be filled). is to move any pills near pill separator 35 back away from the separator before blower 28 is turned off. In this manner, no additional pills will fall onto pill separator 35 when the vacuum force within vacuum drum 10 is released. When vacuum drum 10 has been turned off, step 125 will return the program to the main screen for a new set of instructions from the user.

Steps 112 through 115 illustrate the sequence of steps undertaken by the program to determine if the pill shelf 6 is empty or if pill feeder 40 is empty. If sensor 37 does not detect a pill in step 111, step 112 will read the air drum switch number. The air drum switch number represents the number of times vacuum drum 10 has made a complete revolution as determined by the switch activator 18 on vacuum drum 10 (see FIG. 7) passing and activating a switch 78 (see FIG. 14). Step 113 illustrates that if vacuum drum 10 makes two complete rotations without any pills being detected, then the program branches to step 108 in order to open feed gate 50 and allow further pills to fall on self 6. If a pill is thereafter detected in step 111, the pill counting continues as described above and the air drum switch number is reset to zero (step 117). However, if after opening feed gate 50, sensor 37 still does not detect further pills by the time a third rotation of vacuum drum 10 has occurred, step 114 will branch the program to the "out of pills" position in step 126. In effect, the program has determined that pill reservoir 40 must be empty and step 126 will stop operation of the vacuum drum 10 and indicate to the user on the LCD. screen that the pill reservoir is empty. After the user has filled pill reservoir 40, the user may press a "continue" button which will cause the counter to reenter the main loop of the program and again begin counting pills at the number where it previously left off.

While the present invention has been described in terms of specific embodiments, there are many variations and modifications which are with the scope of the present invention. For example, while FIG. 6 shows how pill shelf 6 may be lowered to dump pills remaining after use of the counter, an alternative would be an "empty" command entered from the user interface. This command would simply have vacuum drum 1 run until pill shelf 6 was empty. Before entering the command, a user would remove pill feeder 40 and hold it upside down beneath discharge aperture 4 with the feed gate 50 open. Entering the empty command would cause any excess pills on shelf 6 to be returned to pill reservoir 41. As another example, the precise control of motor 30 by micro-controller 70 allows great flexibility in handling different sized pills and maximizing efficiency in counting. There may be situations when the counting of larger pills makes it advantageous to rotate vacuum drum 10 at lower speeds than when counting smaller pills. However, if a pill aperture on drum 10 does not contain a pill, it is inefficient to proceed at the same slower rotational speed to the next pill aperture. In this situation, micro-controller 70 may detect the absence of a pill at the pill aperture and momentarily speed up drum 10 to reach the next pill aperture. This ensures drum 10 is operating in the most time efficient manner at all times. As still further example, the control circuitry in the drawings includes a micro-processor. However, the control circuitry could also be "hard wired" using conventional logic circuitry formed on integrated circuits or even constructed with conventional discrete circuit elements. Nor must all embodiments include an integral vacuum drum. Certain embodiments could have a conventional prior art pill disk (as in the '358 Patent), but further include a pill feeder such a disclosed herein as the novel feature. Moreover, certain elements such as pill shelf 6 and pill chute 7, may be disposable or alternatively be covered with paper to ease cleaning and to reduce the possibility of cross-contamination. All such variations and modifications are intended to come within the scope of the following claims.

We claim:

1. A vacuum driven pill counter comprising:

a. a counter housing with a pill discharge aperture formed therein;

b. an integrally formed vacuum drum rotatably positioned in said housing, said vacuum drum having a front wall, a rear wall, and a perimeter wall, said front wall including a plurality of pill apertures formed therein;

c. a vacuum source communicating with said housing and capable of drawing a vacuum through said pill apertures in said vacuum drum;

d. a torque source operatively connected to said vacuum drum in order to rotate said vacuum drum;

e. a pill shelf positioned adjacent to said front wall of said vacuum drum, said pill shelf being arcuate in shape and having a surface inclined downwardly toward said pill drum;

f. a pill separator for removing pills retained on said pill apertures by said vacuum source, said pill separator having a sloping surface positioned adjacent to said pill drum and being connected to said pill shelf;

g. a pill sensor positioned to detect pills which will exit said discharge aperture; and h. control circuitry receiving a signal from said pill sensor and ceasing or changing operation of said pill counter upon a predetermined condition and including a user interface for entering instructions for said control circuitry.

2. The vacuum driven pill counter according to claim 1, wherein said predetermined condition is a given number of pills being detected by said sensor.

3. The vacuum driven pill counter according to claim 1, wherein said discharge passage includes at least one sloping surface.

4. The vacuum driven pill counter according to claim 1, wherein said torque source is a speed controllable electric motor.

5. The vacuum driven pill counter according to claim 4, wherein said motor and said vacuum drum have timing gears to reduce the rotational speed said motor transfers to said vacuum drum.

6. The vacuum driven pill counter according to claim 1, wherein said surface of said pill separator is black.

7. The vacuum driven pill counter according to claim 1, wherein an aperture blocking strip covers a predetermined number of pill apertures.

8. The vacuum driven pill counter according to claim 1, wherein said user interface includes a key pad and viewing screen.

9. A vacuum driven pill counter comprising:

a. a counter housing with a pill discharge aperture formed therein;

b. an vacuum drum rotatably positioned in said housing, said vacuum drum having a front wall, a rear wall, and a perimeter wall, said front wall including a plurality of pill apertures formed therein, said vacuum drum further including a hollow shaft communicating with an interior space of said vacuum drum;

c. a vacuum source communicating with said housing and capable of drawing a vacuum through said pill apertures in said vacuum drum;

d. a torque source operatively connected to said vacuum drum in order to rotate said vacuum drum;

e. a pill shelf positioned adjacent to said front wall of said vacuum drum;

f. a pill separator for removing pills retained on said pill apertures by said vacuum source;

g. a pill sensor positioned to detect pills which will exit said discharge aperture; and h. control circuitry receiving a signal from said pill sensor and ceasing or changing operation of said pill counter upon a predetermined condition and including a user interface for entering instructions for said control circuitry.

10. The vacuum driven pill counter according to claim 9, wherein said hollow shaft extends between said front and rear wall of said vacuum drum and a vacuum aperture in formed in said shaft between said front and rear walls.

11. The vacuum driven pill counter according to claim 9, further including a selective pill feeder having a pill reservoir and a selectively operable feed gate separating said pill reservoir from said pill shelf.

12.The vacuum driven pill counter according to claim 11, wherein said pill feeder further comprises:

a. a frame having a top and bottom aperture, said bottom aperture being positioned over an opening in said counter housing;

b. said pill reservoir positioned on said frame to allow pills to flow into said top aperture of said frame;

c. said feed gate positioned within said frame to be slidably movable between said top and bottom apertures.

13. The vacuum driven pill counter according to claim 9, wherein said front wall of said vacuum drum is a separately formed vacuum disk.

14. A vacuum driven pill counter comprising:

a. a counter housing with a pill discharge aperture formed therein;

b. a vacuum drum rotatably positioned in said housing, said vacuum drum having a front wall, a rear wall, and a perimeter wall, said front wall including a plurality of pill apertures formed therein;

c. a vacuum source communicating with said housing and capable of drawing a vacuum through said pill apertures in said vacuum drum;

d. a torque source operatively connected to said vacuum drum in order to rotate said vacuum drum;

e. a pill shelf positioned adjacent to said front, wall of said vacuum drum;

f. a pill separator for removing pills retained on said pill apertures by said vacuum source;

g. a pill sensor positioned to detect pills which will exit said discharge aperture, wherein said sensor is either a white light emitter or a laser light emitter; and h. control circuitry receiving a signal from said pill sensor and ceasing or changing operation of said pill counter upon a predetermined condition and including a user interface for entering instructions for said control circuitry.

15. A vacuum driven pill counter comprising:

a. a counter housing with a pill discharge aperture formed therein;

b. a vacuum drum rotatably positioned in said housing, said vacuum drum having a front wall, a rear wall, and a perimeter wall, said front wall including a plurality of pill apertures formed therein;

c. a vacuum source communicating with said housing and capable of drawing a vacuum through said pill apertures in said vacuum drum;

d. a torque source operatively connected to said vacuum drum in order to rotate said vacuum drum;

e. a pill shelf positioned adjacent to said front wall of said vacuum drum;

f. a pill separator for removing pills retained on said pill apertures by said vacuum source;

g. a pill sensor positioned to detect pills which will exit said discharge aperture;

h. control circuitry receiving a signal from said pill sensor and ceasing or changing operation of said pill counter upon a predetermined condition and including a user interface for entering instructions for said control circuitry; and i. said vacuum drum having a switch activator for indicating to said control circuitry when said vacuum drum has rotated a given angular distance.

16. A vacuum driven pill counter comprising:

a. a counter housing with a pill discharge aperture formed therein;

b. a vacuum disk rotatably positioned in said housing, said vacuum disk having a plurality of pill apertures formed therein;

c. a vacuum source communicating with said housing and capable of drawing a vacuum through said pill apertures in said vacuum disk;

d. a torque source operatively connected to said vacuum disk in order to rotate said vacuum disk;

e. a pill shelf positioned adjacent to said front wall of said vacuum disk;

f. a pill separator for removing pills retained on said pill apertures by said vacuum source;

g. a pill sensor positioned to detect pills which will exit said discharge aperture; and h. a selective pill feeder regulating the pills allowed to accumulate on the pill shelf.

17. The vacuum driven pill counter according to claim 16, wherein said pill feeder further comprises:

a. a frame having a top and bottom aperture, said bottom aperture being positioned over an opening in said counter housing;

b. said pill reservoir positioned on said frame to allow pills to flow into said top aperture of said frame;

c. a feed gate positioned within said frame to be slidably movable between said top and bottom apertures.

18. The vacuum driven pill counter according to claim 17, wherein said pill feed further comprises a pivot arm connected at a first to said feed gate and connected at a second point to a linear activator device, whereby extension and retraction of said linear activator device opens and close said feed gate.

19. The vacuum driven pill counter according to claim 18, wherein said linear activator device is a solenoid.

20. The vacuum driven pill counter according to claim 18, wherein said feed gate is biased in a shut position.

21. A vacuum driven pill counter comprising:

a. a counter housing;

b. a vacuum disk rotatably positioned in said housing, said vacuum disk having a plurality of pill apertures formed therein;

c. a vacuum source communicating with said housing and capable of drawing a vacuum through said pill apertures in said vacuum disk;

d. a torque source operatively connected to said vacuum disk in order to rotate said vacuum disk;

e. control circuitry for operating said pill counter, said control circuitry performing the step of adjusting the speed of the rotation of said vacuum disk.

22. The vacuum driven pill counter according to claim 21, wherein said control circuitry performs the step of generating a signal to advance a pill container conveyor after a predetermined number of pills have been dispensed into a pill container.

23. The vacuum driven pill counter according to claim 21, wherein said control circuitry performs the step of generating a signal to open a pill dispenser a predetermined length of time.

24. A vacuum driven pill counter comprising:

a. a counter housing;

b. vacuum disk rotatably positioned in said housing, said vacuum disk having a plurality of pill apertures formed therein;

c. a vacuum source communicating with said housing and capable of drawing a vacuum through said pill apertures in said vacuum disk;

d. a torque source operatively connected to said vacuum disk in order to rotate said vacuum disk;

e. control circuitry for operating said pill counter said control circuitry performing the step of adjusting the direction of rotation of said vacuum disk.

25. A vacuum driven pill counter comprising:

a. a counter housing;

b. a vacuum disk rotatably positioned in said housing, said vacuum disk having a plurality of pill apertures formed therein;

c. a vacuum source communicating with said housing and capable of drawing a vacuum through said pill apertures in said vacuum disk;

d. a torque source operatively connected to said vacuum disk in order to rotate said vacuum disk;

e. control circuitry for operating said pill counter, said control circuitry performing the step of controlling the operation of a pill container conveyor.

26. A vacuum driven pill counter comprising:

a. a counter housing;

b. a vacuum disk rotatably positioned in said housing, said vacuum disk having a plurality of pill apertures formed therein;

c. a vacuum source communicating with said housing and capable of drawing a vacuum through said pill apertures in said vacuum disk;

d. a torque source operatively connected to said vacuum disk in order to rotate said vacuum disk;

e. control circuitry for operating said pill counter, said control circuitry performing the step of ceasing operation of said pill counter based on a criteria other than a number pills detected by said sensor.

27. A vacuum driven pill counter comprising:

a. a counter housing;

b. a vacuum disk rotatably positioned in said housing, said vacuum disk having a plurality of pill apertures formed therein;

c. a vacuum source communicating with said housing and capable of drawing a vacuum through said pill apertures in said vacuum disk;

d. a torque source operatively connected to said vacuum disk in order to rotate said vacuum disk.

e. control circuitry for operating said pill counter, said control circuitry performing the step of adjusting the vacuum force generated by said vacuum source based upon an input by a user.

* * * * *